US005353717A

United States Patent [19]

Taylor

[11] Patent Number: 5,353,717

[45] Date of Patent: Oct. 11, 1994

[54] TABLE STRUCTURE

[75] Inventor: Ward Taylor, Hickory, N.C.

[73] Assignee: Autumn House Incorporated, Granite Falls, N.C.

[21] Appl. No.: 104,918

[22] Filed: Aug. 12, 1993

[51] Int. Cl.[5] ..... A47B 3/06

[52] U.S. Cl. ..... 108/157; 108/153

[58] Field of Search ..... 108/157, 153, 154, 159, 108/111, 97, 98; 297/447

[56] References Cited

U.S. PATENT DOCUMENTS

| | | | |
|---|---|---|---|
| D. 142,211 | 8/1945 | Glukes | 108/157 X |
| 2,334,912 | 11/1943 | Eide | 108/153 X |
| 2,582,243 | 1/1952 | Eide | 108/159 X |
| 2,615,771 | 10/1952 | Curtis | 108/159 |
| 2,635,024 | 4/1953 | Sanford | 108/157 |
| 3,844,935 | 11/1974 | Skinner | 297/447 X |
| 4,202,581 | 5/1980 | Fleishman | 108/159 X |

FOREIGN PATENT DOCUMENTS

| | | | |
|---|---|---|---|
| 524755 | 12/1953 | Bulgaria | 108/153 |

*Primary Examiner*—Jose V. Chen
*Attorney, Agent, or Firm*—Rhodes, Coats & Bennett

[57] ABSTRACT

A table structure includes a top and at least a pair of opposed laterally spaced legs. Each leg is disposed at an incline and includes an upper locking opening formed therein. A table top extends completely through the locking openings of the legs and because of the relationship of the legs with the table there is a binding locking action that results and that resulting action maintains the table in an erect mode without there being physical fasteners such as bolts, screws, etc., interconnecting the top with the legs.

5 Claims, 3 Drawing Sheets

TABLE STRUCTURE

FIELD OF THE INVENTION

The present invention relates to table structures.

BACKGROUND OF THE INVENTION

Tables, such as cocktail tables and coffee tables, are typically fabricated such that the leg or base structure of the tables are physically connected to a top through screws, bolts, dowels, etc. This type of physical connection, of course, provides a very sturdy and strong connector.

However, utilizing physical connectors such as bolts, screws, and dowels to connect the base of a table with its top certainly places limitations on the overall design of a table. Furniture designers have found that it is difficult in some cases to design a cocktail or coffee table or other types of tables with a sleek and contemporary look and still be constrained to use physical connectors such as bolts, screws and dowels that tie the base or leg structure of the table with the top.

It is of course known to provide a table structure where the table top simply rests on a stationary base. Here, the table top is not directly connected to the base through a physical interconnector. However, one of the drawbacks to this design is that the table top can be bumped and displaced from the base. That is the top and base are not held in a binding interlocked relationship.

Therefore, there has and continues to be a need for a table design having interlocked top and legs that do not rely on physical connectors such as bolts, screws and dowels to actually penetrate both the base structure and the top.

SUMMARY AND OBJECTS OF THE INVENTION

The present invention entails a table structure that does not rely on physical connectors such as bolts, screws, dowels, etc., to fix and tie the base or leg structure of the table to its top. The present invention entails a table design that includes at least a pair of opposed legs or base structures that are provided with locking openings formed about the top portion thereof such that a table top can be projected through the locking openings in such a fashion that when the entire table structure is rested on a support surface that the weight of the table and particularly the top will result in a binding locking action between the top and the base structure such that the entire table is self-supported and interlocked without the use of physical connectors.

It is therefore an object of the present invention to provide a table design wherein the base of the table and the top of the table are connected without the use of physical connectors.

Another object of the present invention revolves around providing a table design having a pair of opposed legs that support a table top wherein the legs and top are so arranged that an interlocking relationship exists between the table top and legs such that the legs support the table top in an elevated position without the use of physical connectors actually penetrating both the top and the support legs.

Still a further object of the present invention resides in the provision of a table design of the character referred to above that is capable of being embodied in many specific aesthetically pleasing designs.

It is also an object of the present invention to provide a table structure design of the character referred to above wherein the components of the table structure, namely the top and legs, can be quickly and easily disassembled and reassembled.

Other objects and advantages of the present invention will become apparent and obvious from a study of the following description and the accompanying drawings which are merely illustrative of such invention.

DETAILED DESCRIPTION OF THE INVENTION

Figure 1:
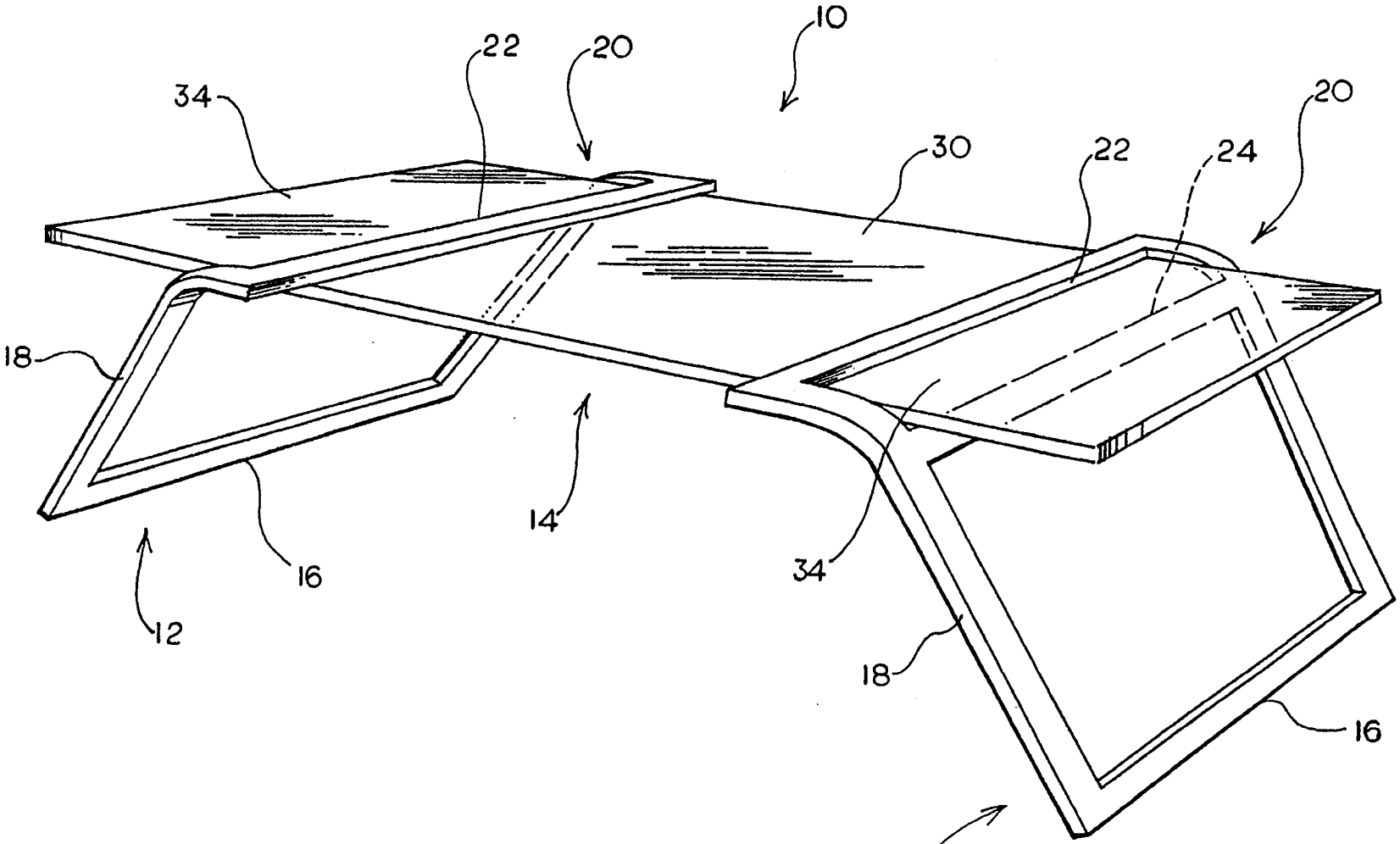
FIG. 1 is a perspective view of the table design of the present invention.
Figures 2, 3:
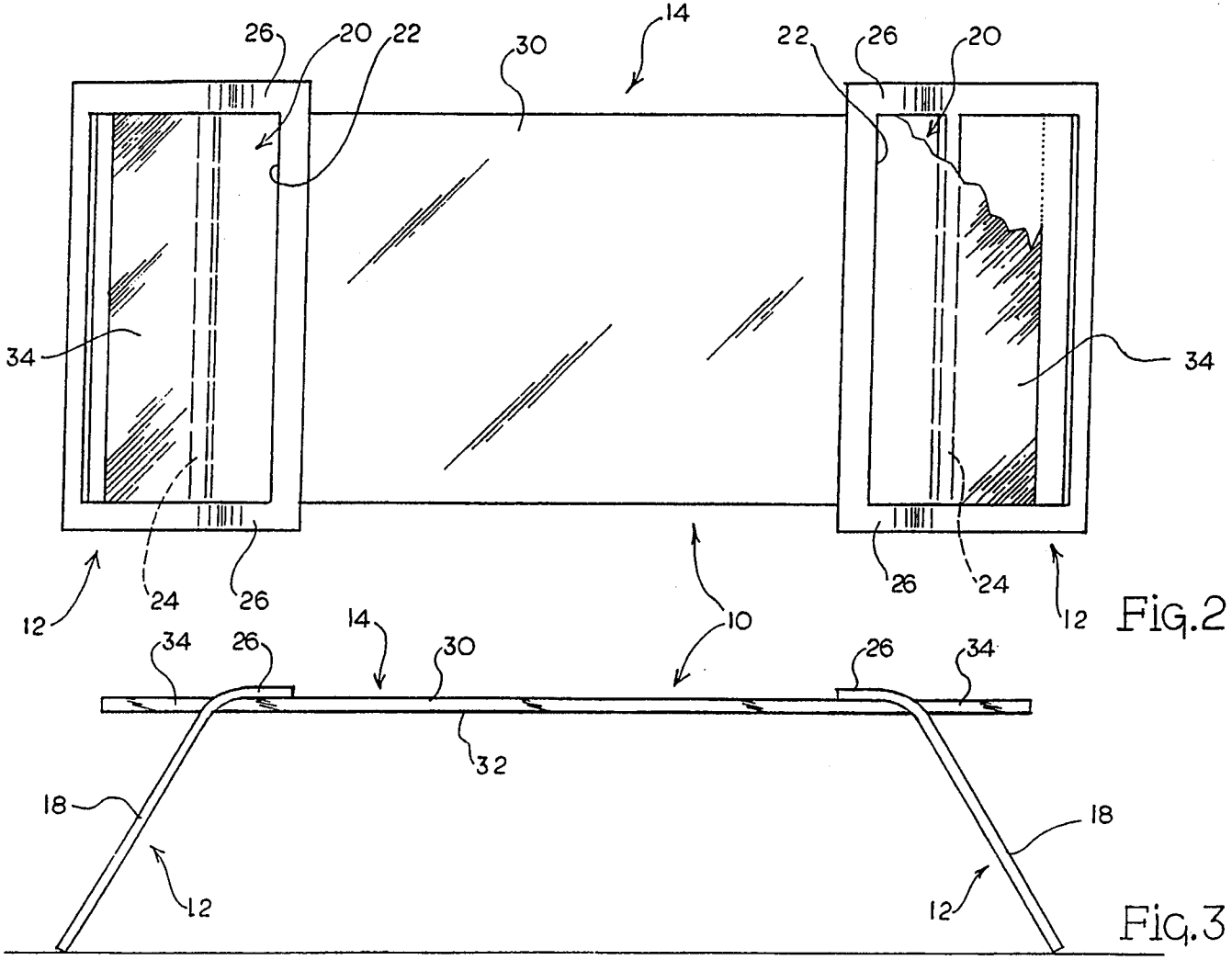
FIG. 2 is a top plan view of the table design of the present invention.
FIG. 3 is a side elevational view of the table design of the present invention.

With further reference to the drawings, the table structure of the present invention is shown therein and indicated generally by the numeral 10. Table 10 in the embodiment disclosed comprises a pair of legs or bases 12 that are laterally spaced and opposed to each other. Extending through the legs 12 and supported thereabove is a table top indicated generally by the numeral 14.

Viewing the present invention in more detail and particularly the legs or base structure 12, it is seen that the leg includes a lower edge 16 that is designed to rest against a support surface. In addition, each leg structure 12 includes a main body portion 18 that extends upwardly from the lower edge 16 towards the table top 14.

Formed in the upper portion of each leg or base structure 12 is a locking opening indicated generally by the numeral 20. As will be appreciated from subsequent portions of this disclosure the locking opening 20 is designed to receive an end portion of the table top 14. More particularly, an end portion of the table top 14 is designed to project through the locking opening 20 in such a fashion that the weight of the top 14 will cause a binding or interlocking relationship to be created between the table top and the locking opening 20 of a respective leg or base 12.

Figure 4:
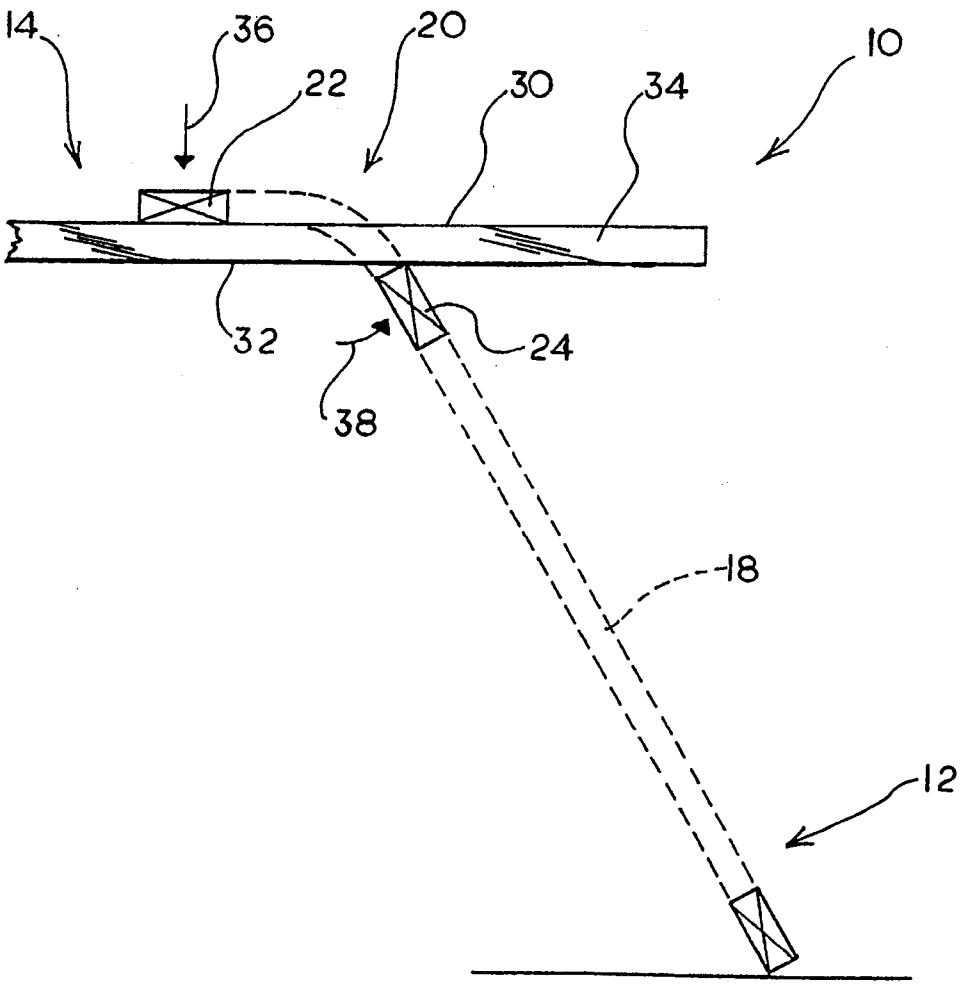
FIG. 4 is a schematic illustration of the interlocking relationship that exists between a leg or base and the table top.

Viewing the locking opening 20 in more detail, it is seen that the same includes an open space for an end portion of the top 14 to pass therethrough. The opening 20 is defined by an upper transverse bearing edge or member 22 and a lower transverse bearing edge or member 24. As seen in the drawings, the bearing edges 22 and 24 are spaced apart and as illustrated in FIG. 4, the bearing edges 22 and 24 are spaced vertically and horizontally apart. The locking opening 20 also includes a pair of opposed sides 26 that together with the upper and lower traverse bearing edges 22 and 24 form the entirety of the locking opening 20.

Now turning to top 14, it is seen that the same includes an upper surface 30 and a lower surface 32. In addition, the top 14 includes a pair of opposed end portions 34 that project through the locking openings 20 of each leg 12 when the table is in an assembled and an erect mode.

As indicated beforehand, the table structure 10 of the present invention is unique inasmuch as the table top and legs are interconnected in such a fashion that no physical connectors such as bolts, screws, dowels, nails, etc., are required. In particular, the legs or bases 12 are so arranged with respect to the table top 14 that a binding and interlocking relationship is created between the table top 14 and each of the legs 12. As illustrated in FIG. 4, the end portion 34 of a table top 14 projects through the locking opening 20 such that the upper transverse bearing member 22 lies adjacent and bears against the upper surface 30 of the top 14. In this same regard, the lower transverse bearing member 24 rests against and bears against the lower surface of the top 14. As apparent from FIG. 4, the weight of the table top 14 itself tends to urge the legs 12 to rotate in a counterclock wise fashion as viewed in FIG. 4. However, the relationship of the upper and lower traverse bearing members 22 and 24 prevents the leg 12 from rotating counterclock wise and actually cause the same to be supported in a sturdy and stable relationship beneath the table top 14. It is noted in FIG. 4 that the lower edge or lower surface 16 of the leg 12 is disposed outwardly of the lower traverse bearing member 24. Also, it is noted that the upper transverse bearing member 22 is disposed inwardly of the lower traverse bearing member 24. This relationship in combination with the table top 14 and its weight contribute to the table being self-supporting and sturdy without the requirements of physical connectors such as bolts, screws, nails, dowels, etc. As indicated in FIG. 4, the reference arrow 36 depicts the tendency of the upper traverse bearing member 22 to move down because of the weight of the table top 14. Construction arrow 38 depicts the tendency of the lower traverse bearing member 24 to rotate counterclock wise because of the angle of disposition of the leg 12 and its relationship with the top 14.

It may be desirable to apply a plastic or rubber tab on the underside 32 of the top 14 or on the upper side of the lower traverse member 24 for the purpose of further securing the top in place.

From the foregoing specification and discussion, it is appreciated that the table structure 10 of the present invention presents a very unique design that lends itself to the creation of cocktail tables and coffee tables and other types of table designs that impart a sleek, contemporary look since the basic design is not constrained by the requirements of physical connectors. The design of the support legs or bases 12 and the relationship of the legs or bases 12 with respect to the top 14 gives rise to a sturdy and stable table design that is self-supporting and which does not require the use of physical connectors such as bolts, screws, dowels, etc.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A self-supporting table that is supported by the combined locking action of its legs with its top comprising in an assembled and erect mode:

a) a table top having a pair of opposed end portions, a top surface and a bottom surface;

b) a pair of laterally spaced legs supporting the table top with each leg being inclined with respect to the top;

c) an opening formed in the top portion of each leg for receiving an end portion of the table top and wherein an end portion of the table top extends completely through a respective opening in the leg;

d) each opening within a respective leg including a pair of spaced apart engaging edges that cooperate to lock against the upper and lower surfaces of the top so as to generally form a fixed and supported relationship between the top and the respective leg; and e) wherein the spaced apart engaging edges of the opening formed in each leg includes an upper edge that bears downwardly onto the top surface of the table and a lower edge that bears upwardly against the lower surface of the table so as to effectively lock the respective leg about the end portion of the top such that the same cannot rotate about the top and thereby forms a fixed and supported relationship between the top and the respective leg.

2. The table of claim 1 wherein the top bearing edge of the leg opening is spaced inwardly of the upper bearing edge of the same leg opening.

3. A table that stands erect solely by a binding-locking action between opposed legs and a table top that in an erect mode comprises:

a) a pair of inclined opposed legs with each leg having a locking opening formed in a top portion thereof;

b) each locking opening having an upper transverse bearing edge, a lower transverse bearing edge, and a pair of side edges and wherein the upper and lower transverse bearing edges are laterally spaced;

c) a top having upper and lower surfaces and a pair of opposed end portions with each end portion projecting completely through a respective locking opening of a leg and forming a binding interlocked relationship with the leg of that locking opening; and d) wherein the upper transverse bearing edge of the locking opening bears downwardly against the upper surface of the table top while the lower traverse bearing edge bears upwardly against the lower surface of the top so as to fix the respective legs with respect to the top and prevent the legs from rotating with respect to the top such that the weight of the top itself along with the binding action of the top and the legs forms an erect table having no physical interconnectors such as bolts, screws, etc.

4. The table of claim 3 wherein the legs are inclined upwardly and inwardly towards each other.

5. The table of claim 4 wherein each leg includes a base portion that extends between a support surface and the bottom surface of the top and wherein the upper traverse bearing edge lies outside of the plane of the base portion of the leg.

* * * * *